US006021293A

United States Patent [19]

Anno et al.

[11] Patent Number: 6,021,293

[45] Date of Patent: Feb. 1, 2000

[54] NEGATIVELY CHARGEABLE DEVELOPING AGENT FOR MONO-COMPONENT DEVELOPMENT, MONO-COMPONENT DEVELOPING DEVICE USING THE DEVELOPING AGENT, AND IMAGE-FORMING APPARATUS

[75] Inventors: Masahiro Anno, Sakai; Hiroyuki Fukuda, Sanda, both of Japan

[73] Assignee: Minolta Co., Ltd., Osaka, Japan

[21] Appl. No.: 09/140,446

[22] Filed: Aug. 26, 1998

[30] Foreign Application Priority Data

Aug. 29, 1997 [JP] Japan ..... 9-234238

[51] Int. Cl.[7] ..... G03G 15/08; G03G 9/097

[52] U.S. Cl. ..... 399/252; 399/149; 430/110

[58] Field of Search ..... 430/110, 109, 430/107, 106; 399/149, 252, 150

[56] References Cited

U.S. PATENT DOCUMENTS

| | | | |
|---|---|---|---|
| 4,640,882 | 2/1987 | Mitsuhashi et al. | 430/110 |
| 4,828,954 | 5/1989 | Hashimoto et al. | 430/110 |
| 4,973,540 | 11/1990 | Machida et al. | 430/110 |
| 5,021,317 | 6/1991 | Matsubara et al. | 430/110 |
| 5,024,915 | 6/1991 | Sato et al. | 430/110 |
| 5,176,979 | 1/1993 | Eguchi et al. | 430/110 |
| 5,215,849 | 6/1993 | Makuta et al. | 430/110 |
| 5,256,511 | 10/1993 | Matsumura et al. | 430/108 |
| 5,281,505 | 1/1994 | Inoue et al. | 430/106 |
| 5,604,574 | 2/1997 | Matsuura et al. | 399/350 |
| 5,665,511 | 9/1997 | Imai et al. | 430/110 |
| 5,702,857 | 12/1997 | Nagai et al. | 430/101 |
| 5,716,748 | 2/1998 | Hasegawa et al. | 430/110 |
| 5,804,347 | 9/1998 | Inoue et al. | 430/110 |
| 5,824,442 | 10/1998 | Tanikawa et al. | 430/45 |

FOREIGN PATENT DOCUMENTS

| | | |
|---|---|---|
| 4-340558 | 11/1992 | Japan . |
| 8-194330 | 7/1996 | Japan . |

*Primary Examiner*—R. L. Moses

*Attorney, Agent, or Firm*—Burns, Doane, Swecker & Mathis, LLP

[57] ABSTRACT

The present invention relates to a negatively chargeable developing agent for mono-component development comprising;

toner particles containing a binder resin and a colorant; and inorganic fine particles which are treated with a hydrophobicizing agent and a surface treating agent having a cationic group, the inorganic fine particles externally added to the toner particles and having a blow-off charge quantity (Q) $-800<Q<0$ $\mu$C/g relative to iron oxide particles, the negatively chargeable developing agent being suitable for use in a mono-component developing device and image-forming apparatus.

20 Claims, 1 Drawing Sheet

Fig. 1
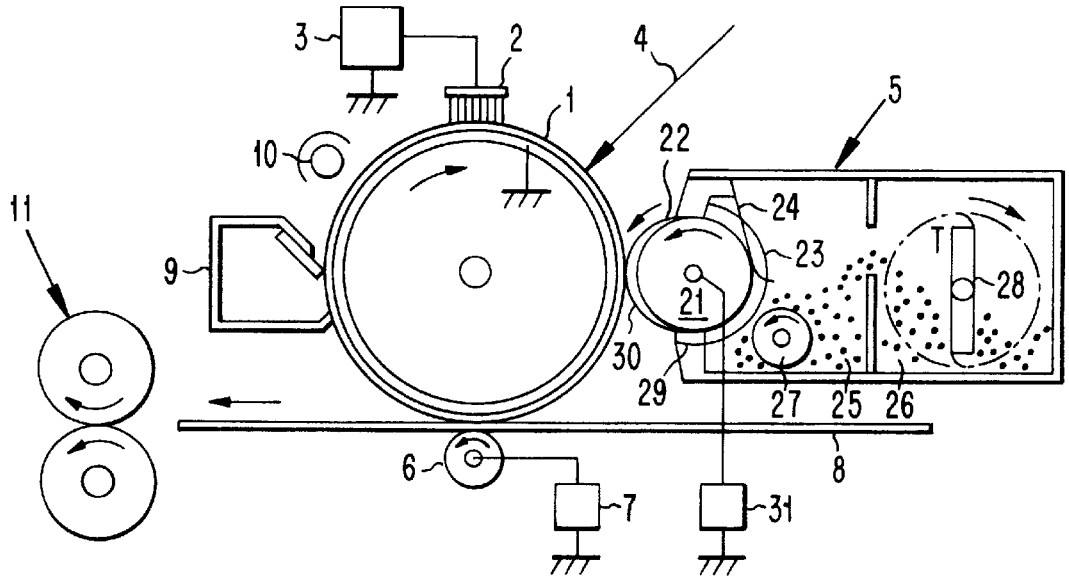
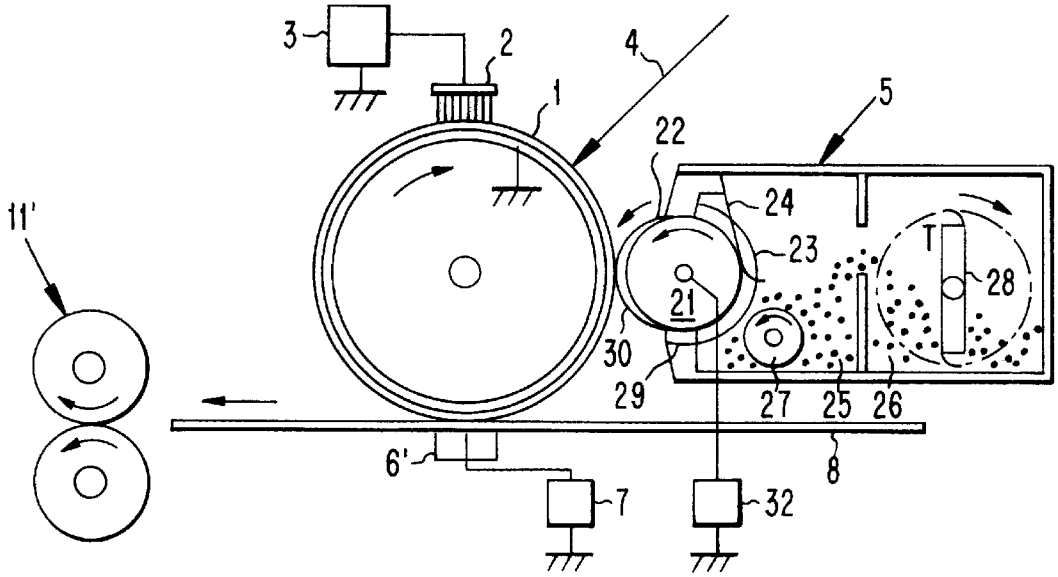
Fig. 2

NEGATIVELY CHARGEABLE DEVELOPING AGENT FOR MONO-COMPONENT DEVELOPMENT, MONO-COMPONENT DEVELOPING DEVICE USING THE DEVELOPING AGENT, AND IMAGE-FORMING APPARATUS

This application is based on application Serial No. Hei 9-234238 filed in Japan, the contents of which are hereby incorporated by reference.

BACKGROUND OF THE INVENTION

1. Field of the Invention

The present invention relates to a negatively chargeable developing agent for mono-component development, mono-component developing device using the developing agent and image-forming apparatus, being suitable for electrophotography, electrostatic recording, and electrostatic printing.

2. Description of the Related Art

For development of electrostatic latent images there have been known two systems, one known as two component development system wherein a mixture of a magnetic carrier and a non-magnetic toner is used, the other known as mono-component development system wherein no carrier is used. The two component development system has occupied a major share and has therefore been more widely used. Recently, however, the mono-component development system has been widely used in the art, because the system does not require the use of carrier and, hence, does not require carrier replacement, and because stable image-formation can be achieved by using a developing unit which is compact and simple in construction.

The mono-component development system is a system such that a thin layer of charged toner, formed on a developing sleeve as toner particles are forced to pass through a pressure contact clearance between the sleeve and a toner regulating blade, acts to develop an electrostatic latent image formed on a photosensitive member. Toner charging is effected at the pressure contact portion of the toner regulating blade.

However, the time allowed for the toner to contact the toner regulating blade is so short that toner particles should be triboelectrically charged to a predetermined charge level within an extremely limited period of time. Therefore, it is required that the toner be able to be charged quickly to the predetermined charge level.

If the toner charge is insufficient or if the toner is excessively charged, with the result that there should occur fluctuations in the quantity of charge, it is not possible to achieve any smooth and uniform image transfer from the development sleeve to the photosensitive member and/or from the photosensitive member to a recording medium, such as paper. This may cause fogging with respect to images formed.

Toner particles left on the developing sleeve after development of the electrostatic latent image on the photosensitive member returns to the charging region between the regulating blade and the developing sleeve so that the remaining toner particles go into contact with the regulating blade for being charged again. This means that the toner particles are triboelectrically charged two times. As a result, the toner is electrically charged more than normally required. The presence of such toner particles causes variations in toner charge, and this inevitably results in aforementioned fogging. Therefore, once the toner is charged to a specified level, stability at that level is required of the toner.

Toner charge varies according to the environmental condition in which the toner is placed. Therefore, it is required that toner charge should have good environmental stability.

SUMMARY OF THE INVENTION

The present invention was developed in view of the above mentioned problems with the prior art.

It is a primary object of the invention to provide a negatively chargeable toner suitable for use in a developing method such that a thin layer of charged toner, formed on a developing sleeve as toner particles are forced to pass through a pressure contact clearance between the sleeve and a toner regulating blade, acts to develop an electrostatic latent image formed on a photosensitive member.

It is another object of the invention to provide a negatively chargeable toner which exhibits quick electrification build-up properties and constant charging performance, and which has good environmental stability.

The above objects can be accomplished by externally adding to the toner inorganic fine particles treated with a hydrophobicizing agent and with a silane coupling agent having a cationic group and/or a silicone oil having a cationic group, the inorganic fine particles having a blow-off charge quantity (Q) of $-800<Q<0\ \mu C/g$ relative to iron oxide particles.

BRIEF DESCRIPTION OF THE DRAWINGS

FIG. 1 is a schematic view showing the arrangement of an image-forming apparatus including a mono-component developing device.

FIG. 2 is a schematic view showing a modification of the arrangement of an image-forming apparatus including a mono-component device.

DETAILED DESCRIPTION OF THE INVENTION

The present invention provides a negatively chargeable developing agent for mono-component development comprising;

toner particles containing a binder resin and a colorant; and inorganic fine particles which are treated with a hydrophobicizing agent and a surface treating agent having a cationic group, the inorganic fine particles externally added to the toner particles and having a blow-off charge quantity (Q) of $-800<Q<0\ \mu C/g$ relative to iron oxide particles, the negatively chargeable developing agent being suitable for use in a mono-component developing device and image-forming apparatus.

For inorganic fine particles usable in the present invention, silica, titanium dioxide, alumina, zinc oxide, strontium titanate, and calcium titanate are exemplified. Such fine particles as have a mean primary particle size range of from 0.001 to 5 $\mu$m, preferably from 0.01 to 1 $\mu$m are preferably used.

More specifically, as such silica fine particles the following are commercially available: those produced by a dry process including AEROSIL 50, AEROSIL 90G, AEROSIL 130, AEROSIL 200, AEROSIL 300, AEROSIL 380, AEROSIL TT600, AEROSIL MOX170, AEROSIL MOX80, and AEROSIL COK84 (all made by Nihon Aerosil K. K.); Ca—O—SiL L-90, Ca—O—SiL LM-130, Ca—O—SiL LM-150, Ca—O—SiL M-5, Ca—O—SiL PTG, Ca—O—SiL MS-55, Ca—O—SiL H5, Ca—O—SiL HS5, and Ca—O—SiL EH-5 (all made by CABOT K. K.); WACKER HDK, WACKER N20, WACKER U15, WACKER N20E, WACKER T30, and WACKER T40 (all made by WACKER-CHEMIE GMBH); D-C Fine Silica (made by Dow Corning K. K.); Fransol (made by Fransil K. K.); and Admafine SO-E2,Admafine SO-E3,Admafine SO-C2, Admafine SO-C3, and Admafine SO-C5 (all made by Admatechs K. K.); and those produced by a wet process including Carplex #67, Carplex #80, Carplex #100, Carplex #1120, FPS-1, FPS-3, and FPS-4 (all made by Shionogi Seiyaku K. K.) ; and Seehoster (made by Nihon Shokubai K. K.).

Titanium dioxide fine particles usable in the invention are commercially available in various types, including anatase-type titanium dioxide particles, such as KA-10, KA-15, KA-20, KA-30, KA-35, KA-80, KA-90, and STT-30 (all made by Chitan Kogyo K. K.); rutile-type titanium dioxide particles, such as KR-310, XR-380, KR-460, KR-480, KR-270, and KV-300 fall made by Chitan Kogyo K. K.); titanium dioxide particles made by Teika K. K. which are available on the market under the trade names of MT-150A, MT-600B, MT-100S, MT-500B, JR-602S, and JR-600A; and titanium dioxide particles made by Nihon Aerosil K. K. which are available on the market under the trade name of P25.

Alumina fine particles usable in the invention are commercially available under the following trade names: Aluminium Oxide C (made by Nihon Aerosil K. K.); and Admafine AO-500, Admafine AO-502, Admafine AO-509, Admafine AO-800, Admafine AO-802, and Admafine AO-809 (all made by Admatechs K. K.).

Zinc oxide fine particles usable in the invention are commercially available under the following trade names: ZINCOX SUPER, ZINCOX SUPER-10, ZINCOX SUPER-20R, ZINCOX SUPER-30, 23-K, 23-K(A), and 23-K(C) (all made by Hakusui Kagaku Kogyo K. K.).

Strontium titanate fine particles usable in the invention are commercially available, including those sold under the trade name of ST (made by Fuji Chitan Kogyo K. K.).

Calcium titanate fine particles usable in the invention are commercially available, including those sold under the trade name of CT (made by Fuji Chitan Kogyo K. K.).

In the present invention, such inorganic fine particles as mentioned above are treated with a hydrophobicizing agent and a silane coupling agent having a cationic group and/or a silicone oil having a cationic group.

For use as a hydrophobicizing agent in the above connection the following may be enumerated: silane coupling agents, such as chlorosilane, alkylsilane, alkoxysilane, and silazane, and silicone oil.

More specifically, the following may be given as examples of silane coupling agents:

$CH_3SiCl_3$ $(CH_3)_2SiCl_2$ $(CH_3)_3SiCl$ $CH_3Si(OCH_3)_3$ $CH_3Si(OCH_2CH_3)_3$ $(CH_3)_3Si(OCH_3)$ $(CH_3)_2Si(OCH_3)_2$ $(CH_3)_2Si(OCH_2CH_3)_2$

-continued $Si(OCH_2CH_3)_4$ $Si(OCH_3)_4$ $CH_3(H)Si(OCH_3)_2$ $CH_3(H)Si(OCH_2CH_3)_2$ $(CH_3)_2(H)Si(OCH_2CH_3)$

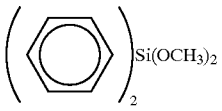

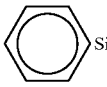

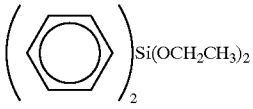

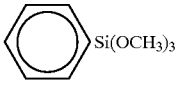

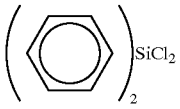

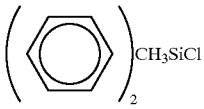

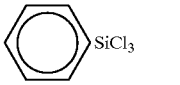

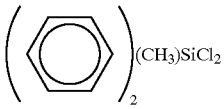

$(CH_3)_3SiNHSi(CH_3)_3$ $(CH_3(CH_2)_{17}Si(CH_3)(OCH_3)_2$ $CH_3(CH_2)_{17}Si(OCH_3)_3$ $CH_3(CH_2)_{17}Si(OC_2H_5)_3$ $CH_3(CH_2)_3Si(CH_3)_2Cl$ $CH_3(CH_2)_{17}Si(CH_3)_2Cl$ $CH_3(CH_2)_{17}Si(CH_3)Cl_2$ $CH_3(CH_2)_{17}SiCl_3$

For the silicone oil, silicone oils having a viscosity of 0.5 to 10,000 centistoke, preferably 1 to 1,000 centistoke, at 25° C. are preferably used including, for example, dimethyl silicone oil, methyl phenyl silicone oil, α-methylstyrene modified silicone oil, chlorophenyl silicone oil, and fluorine-modified silicone oil.

The quantity of the hydrophobicizing agent to be used in the present invention is within the range of from 1 to 50 parts by weight, preferably from 5 to 30 parts by weight, relative to 100 parts by weight of inorganic fine particles.

For the treating agent having a cationic group, amino silane, an amonium salt group-containing silane, and an amino-modified silicone oil may be used.

The amino silane is a so-called amino functional silane, and any amino silane expressed by the following general formula may be used as such:

$$X_mSiY_n$$

(in which, X denotes an alkoxy group or chlorine atom; m denotes an integer of 1–3; Y denotes a hydrocarbon group having a primary, secondary or tertiary amino group; and n denotes an integer of 1–3).

Specifically,

1) $H_2N—CH_2CH_2NHCH_2CH_2CH_2—Si(CH_3)—(OCH_3)_2$

2) $H_2N—CONH—CH_2CH_2CH_2—Si—(OC_2H_5)_3$

3) $H_2N—CH_2CH_2CH_2—Si—(OC_2H_5)_3$

4) $H_2N—CH_2CH_2NHCH_2CH_2CH_2—Si—(OCH_3)_3$

5) $H_2N—CH_2CH_2CH_2—Si—(OCH_3)_3$

6) $H_2N—CH_2CH_2NHCH_2CH_2NHCH_2CH_2CH_2—Si—(OCH_3)_3$

7) $H_5C_2OCOCH_2CH_2NHCH_2CH_2CH_2—Si—(OCH_3)_3$

8) $H_5C_2OCOCH_2CH_2NHCH_2CH_2NHCH_2CH_2CH_2—Si—(OCH_3)_3$

9) $H_5C_2OCOCH_2CH_2NHCH_2CH_2NHCH_2CH_2NHCH_2CH_2—NHCH_2CH_2CH_2—Si—(OCH_3)_3$

10) $NH_2C_6H_4—Si—(OCH_3)_3$

11) $C_6H_5NHCH_2CH_2CH_2—Si—(OCH_3)_3$ 12) poly(aminoalkyltrialkoxysilane)

13) 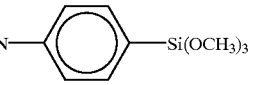

14) 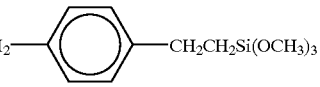

15) 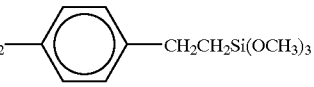

16) 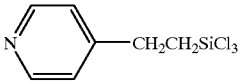

17) $H_2NCH_2Si(OCH_3)_3$

18) $H_2NCH_2CH_2Si(OC_2H_5)_3$

19) $H_2NCH_2CH_2CH_2Si(CH_3)(OC_2H_5)_2$

20) $H_2NCH_2CH_2CH_2Si(OCH_3)_2$

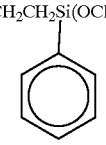

21) 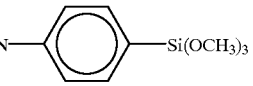

22) $(C_2H_5)(H)N—CH_2CH_2CH_2Si(CH_3)(OCH_3)_2$

-continued

23) $(C_2H_5)(H)N—CH_2Si(CH_3)(OCH_3)_2$

24) $(CH_3)(H)N—CH_2Si(CH_3)(OCH_3)_2$

25) $(CH_3)(CH_3)N—CH_2Si(CH_3)(OC_2H_5)_2$

26) $(CH_3)(CH_3)N—CH_2Si(CH_3)_2(OC_2H_5)$

27) $(C_2H_5)(C_2H_5)N—CH_2Si(CH_3)(OCH_3)_2$

28) $(CH_3)(CH_3)N—CH_2CH_2Si(CH_3)(OCH_3)_2$

29) $(C_3H_7)(C_3H_7)N—CH_2CH_2Si(CH_3)(OCH_3)_2$

30) $(C_4H_9)(C_4H_9)N—CH_2CH_2CH_2Si(CH_3)(OCH_3)_2$

31) $(C_4H_9)(C_4H_9)N—CH_2CH_2CH_2Si(OCH_3)_2(OC_2H_5)$

32) $H_2NCH_2CH_2CH_2Si(CH_3)(OCH_3)_2$

33) $H_3COCOCH_2CH_2NHCH_2CH_2CH_2Si(OCH_3)_3$

34) $H_5C_2OCOCH_2CH_2NHCH_2CH_2NHCH_2CH_2NHCH_2CH_2NHCH_2CH_2CH_2Si(OCH_3)_3$

35) $H_3COCOCH_2CH_2NHCH_2CH_2NHCH_2CH_2CH_2Si(OCH_3)_3$

36) $(H_5C_2)(H_5C_2)N—CH_2CH_2CH_2Si(OCH_3)_3$

37) 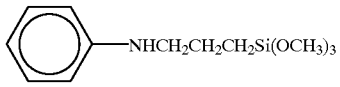

38) 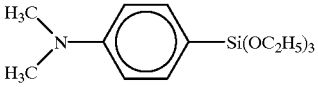

are exemplified.

For the amonium salt group-containing silane, specifically, (1)

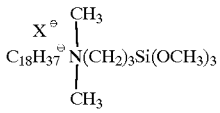

(2)

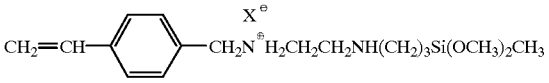

(3)

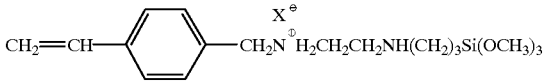

(4)

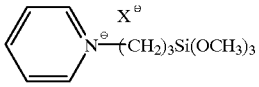

(5)

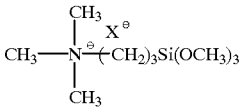

(6)

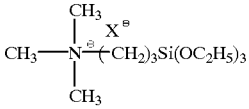

(7)

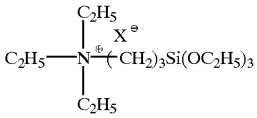

(8)

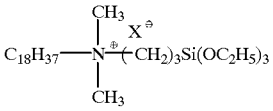

(9)

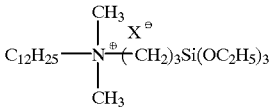

(10)

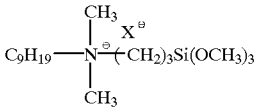

$X^{\ominus}$: anion group ($Cl^{\ominus}$, $Br^{\ominus}$, $I^{\ominus}$, $CH_3COO^{\ominus}$)

are exemplified.

In addition to the above, those in which the alkoxy group of the organosilane is replaced by other hydrolytic group or hydroxyl group may be enumerated, and two or more kinds of such organosilane may be used in combination.

For the amino-modified silicone oil, those expressed by the following general formula are usable as such:

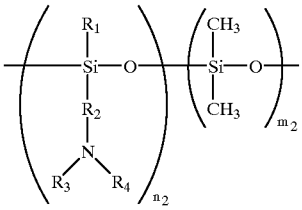

(in which, $R_1$ denotes a hydrogen atom, an alkyl group, an aryl group, or an alkoxy group; $R_2$ denotes an alkylene group or phenylene group; and $R_3$, $R_4$ denote a hydrogen atom, an alkyl group or an aryl group; the alkyl group, aryl group, alkylene group, or phenylene group may contain amine or may have a substituent group, such as a halogen atom, unless the chargeability of the toner is thereby adversely affected; and m and n denotes a positive integer).

Specifically, the following are commercially available.

| Trade name | Viscosity at 25° C.(cps) | Amine equiv. |
|---|---|---|
| SF8417 (made by Toray-Silicone K.K.) | 1200 | 3500 |
| KF393 (made by Shinetsu Kagaku K.K.) | 60 | 360 |
| KF857 (made by Shinetsu Kagaku K.K.) | 70 | 830 |
| KF860 (made by Shinetsu Kagaku K.K.) | 250 | 7600 |
| KF861 (made by Shinetsu Kagaku K.K.) | 3500 | 2000 |
| KF862 (made by Shinetsu Kagaku K.K.) | 750 | 1900 |
| KF864 (made by Shinetsu Kagaku K.K.) | 1700 | 3800 |
| KF865 (made by Shinetsu Kagaku K.K.) | 90 | 4400 |
| KF369 (made by Shinetsu Kagaku K.K.) | 20 | 320 |
| KF383 (made by Shinetsu Kagaku K.K.) | 20 | 320 |
| X-22-3680 (made by Shinetsu Kagaku K.K.) | 90 | 8800 |
| X-22-380D (made by Shinetsu Kagaku K.K.) | 2300 | 3800 |
| X-22-3801C (made by Shinetsu Kagaku K.K.) | 3500 | 3800 |
| X-22-3810B (made by Shinetsu Kagaku K.K.) | 1300 | 1700 |

The term "amine equivalent (equiv.)" means an equivalent to one amine (g/equiv), that is, the value of the molecular weight divided by the number of amines for one molecule.

The quantity of the treating agent having a cationic group which is to be used in the present invention is 0.1 to 20 parts by weight, preferably 0.5 to 10 parts by weight.

For the purpose of treating inorganic fine particles with such a hydrophobicizing agent and such a surface treating agent having a cationic group as above mentioned, the surface treating agent is diluted by being mixed with a solvent, such as tetrahydrofuran (THF), toluene, ethyl acetate, methyl ethyl ketone, acetone ethanol, or hydrogen chloride saturated ethanol. While the inorganic fine powder is forcibly agitated by a blender or the like, the diluted liquid of the surface treating agent is added dropwise or by spraying to the inorganic fine powder and mixing is thoroughly effected. In this connection, various devices, such as kneader-coater, spray dryer, kermal processor, and fluidized bed, may be employed.

Next, the resulting mixture is transferred into a vat, which is then heated and dried in an oven. Thereafter, the dried mixture is thoroughly disintegrated in a mixer, jet mill or the like. It is desirable that particle classification be carried out as required. In the foregoing process, respective surface treating agents may be used either simultaneously or separately for treatment.

In addition to above described dry method, there is a wet treating method such that finely divided inorganic powder is immersed in an organic solvent solution of a coupling agent and then dried, or such that after finely divided inorganic powder is dispersed in water and made into a slurry form, an aqueous solution of a surface treating agent is added dropwise onto the inorganic fine powder which in turn is settled, heated to dry, being then disintegrated. The heating temperature is preferably 100° C. or more. If the temperature is less than 100° C., the condensation reaction of the inorganic fine powder with the surface treating agent can hardly be completed.

In the present invention, it is necessary that finally obtained inorganic fine particles should have a hydrophobicity of 30% or more, preferably 50% or more, and that the inorganic fine particles should have a blow-off charge quantity (Q) of $-800<Q<0$ $\mu$C/g, preferably −700 to −200 $\mu$C/g, relative to iron oxide particles.

In the present invention, hydrophobicity is calculated in the following way. Fifty (50) ml of pure water is put in a 200 ml beaker and 0.2 g of silica is added. With the beaker held under stirring, a methanol dehydrated with sodium sulfoanhydride is added until little or no silica is recognized on the liquid surface. Hydrophobicity is calculated from the quantity of methanol required and according to the following equation.

$$\text{Hydrophobicity } (\%)=C/(50+C)\times 100$$

(in which C denotes quantity of methanol used (ml)).

Measurement of blow-off charge of inorganic fine particles was made by using a blow-off powder charge measuring apparatus (made by Toshiba Chemical K. K.). Measurements are shown in values as obtained when mixing was made in a tumbling mixer for 1 minute with the sample concentration set at 0.2 wt. % relative to the iron oxide powder carrier (Z-150/250, made by Powdertech K. K.) and under conditions of: SUS 400 mesh and blow pressure of 1 kgf/cm$^2$, 60 sec.

The toner to be loaded with such inorganic fine particles as obtained in the above mentioned way is a non-magnetic negatively chargeable toner which comprises at least a binder resin and a colorant and may contain other desired additives, such as anti-offset agent, a charge control agent, and other kinds of resin fine particles. Preferably, the toner has a volume mean particle size of 2 to 10 $\mu$m, preferably 5 to 9 $\mu$m. Toners which can be advantageously used in the present invention include preferably not more than 2% by weight of particles having not less than two times (2D) the volume mean particle size (D), and not more than 5% by number of particles having a particle size of not more than one third (D/3) of the volume mean particle size.

For preparation of toners in accordance with the present invention, toners produced by any known method, for example, a pulverizing method, a wet method, such as suspension polymerization/suspension granulation method, a microcapsule method, a spray dry method, or a mechanochemical method. Toner particle size values given show measurements obtained by using a Coulter Multisizer (made by Coulter Counter), with aperture diameter set at 50 $\mu$m.

Inorganic fine particles of the present invention are added to such a toner within a quantity range of 0.01 to 10 parts by weight, preferably 0.1 to 5 parts by weight, relative to 100 parts by weight of the toner.

The toner obtained in this way is applied for use in such a non-magnetic mono-component developing device (a developing device in which the toner supporting member has no magnetic member, such as a magnetic roll) as schematically illustrated by way of example in FIG. 1. The developing device is so constructed that a regulating blade is held in pressure contact with the surface of the toner supporting member (developing sleeve) so as to control a quantity of the toner on the surface of the toner supporting member and to triboelectrically charge the toner supplied to the surface of the toner supporting member so that the triboelectrically charged toner is supplied from the toner supporting member to the photosensitive member.

In FIG. 1, a photosensitive drum 1 has a photosensitive layer formed on an electroconductive substrate and is driven to rotate in the direction of the arrow shown. A charging brush 2, as a charging member, is disposed in contact relation with the surface of the photosensitive drum 1. A power supply 3 applies a predetermined voltage to the charging brush 2 to charge the surface of the photosensitive drum 1 to predetermined polarity and surface potential. An electrostatic latent image is formed by image exposure 4 on the surface of the photosensitive drum 1 which has been charged to the predetermined potential. The electrostatic latent image is developed by a nonmagnetic mono-component developing device 5 so as to be formed into a toner image. The mono-component developing device 5 will be hereinafter described in detail.

A transfer member or transfer roller 6 has an electroconductive layer formed on the outer periphery of its core and is held in pressure engagement with the photosensitive drum 1 under a predetermined pressure. The transfer roller rotates in the direction of the arrow shown. A bias of a polarity opposite to the charge polarity of the toner is applied to the transfer roller 6 by a power supply 7. A transfer medium 8 is transported to a clearance between the photosensitive drum 1 and the transfer roller 6, and a toner image on the photosensitive drum 1 is transferred onto the transfer medium 8 under above mentioned bias.

The transfer medium 8, with a toner image transferred on its surface, is transported to a fixing device equipped with a fixing roller pair 11 (spring pressure: 4.5 kg) including a heating roller (20 mm in diameter) having a heater therein and a pressing roller (20 mm in diameter) held in abutment against the heating roller. As the transfer medium 8 passes through the clearance between the fixing roller pair 11, the toner image carried on the surface of the transfer medium 20 is fixed.

After toner image transfered to transfer medium 8, the surface of the photosensitive drum 1 is cleared of residual toner and foreign matter, such as paper dust, by a cleaning device 9 having a cleaning blade and is then erased by light irradiation from a eraser so as to be ready for next image-forming process.

The mono-component developing device 5 to which the toner of the present invention is applied includes a drive roller 21 which is driven by a drive means not shown to rotate in the direction of the arrow shown, with a flexible developing sleeve 22 fitted over the drive roller, the developing sleeve 22 having an inner diameter slightly larger than the outer diameter of the roller. The developing sleeve 22 is pressed from behind at its both ends by a pressing guide 23 against the drive roller 21, while on the other hand a loose portion 30 formed at the opposite side by such pressure contact is in soft contact with the photosensitive drum 1. A toner regulating blade 24 is in contact against the developing sleeve 22 at the same side as the pressing guide 23.

A buffer chamber 25 is located behind the developing sleeve 22, and a toner feed chamber 26 is located behind the buffer chamber 25. A toner feed rotary member 27 is disposed in the buffer chamber 25, and a toner agitation/feed rotary member 28 is disposed in the toner feed chamber 26. A lower sealing member 29 for preventing toner leak from the buffer chamber 25 is in contact with the underside of developing sleeve 22. According to the arrangement of the developing device, non-magnetic mono-component toner, fed from the toner feed chamber 26 into the buffer chamber 25 through rotation of the rotary member 28, is sequentially supplied to the surface of the developing sleeve 22 through rotation of the toner feed rotary member 27.

The developing sleeve 22 is in rotation by frictional force following the drive rotation of the drive roller 21, and the toner supplied to the developing sleeve 22 is triboelectrically charged under the pressure of a toner regulating blade 24 as the toner passes through the clearance between the blade 24 and the sleeve 22, being then formed into a thin layer of a predetermined thickness. The thin toner layer is supported on the surface of the developing sleeve 22 and is transported to a developing region facing the photosensitive drum 1 for electrostatic latent image development under a proper bias apply from a power supply 31.

Above described is one example of a non-magnetic mono-component developing device in which the toner of the present invention can be advantageously used. It is understood, however, that the developing arrangement to which this invention is applicable is not limited to the above described arrangement. For example, in FIG. 1 developing device the developing sleeve 22 has an inner diameter larger than the outer diameter of the drive roller 21 such that a loose portion 30 is formed. However, an arrangement in which such a loose portion is not formed, that is, a developing sleeve having an inner diameter comparable to the outer diameter of the drive roller 21 is usable.

Image-forming apparatus to which the toner of the present invention is applicable is not limited to the apparatus illustrated in FIG. 1. For example, the toner of the invention is applicable to the image-forming apparatus shown schematically in FIG. 2.

The image-forming apparatus shown in FIG. 2 has no cleaning device 9 nor eraser 10 both of which the FIG. 1 image-forming apparatus has. Cost reduction is intended. The toner of the present invention can be advantageously used in such an image-forming apparatus having no cleaning device. The reason for this is that since the toner of the invention has good transferability the amount of residual toner present on the photosensitive member is considerably reduced. The developing device 5 carries out collection of residual toner and development of electrostatic latent image. Charging brush 2 carries out charging and destaticization of the photosensitive drum 1. Development is carried out under application of a proper bias from a power supply 32, and cleaning of residual toner is carried out under application of a proper cleaning bias from the power supply 32. The apparatus has a needle electrode 6', as a transfer device, to which a bias of a polarity opposite to the charging polarity of the toner is applied by a power supply 7. A fixing roller pair 11' (spring pressure 6.2 kg) includes a heating roller (not shown) disposed therein and a pressing roller held in abutment against the heating roller, the heating roller having a diameter (16 mm) smaller than the diameter (20 mm) of the pressing roller. Because of this arrangement, the fixing nip width is made wider, with improvement in the fixing performance for card board.

The following examples are given to further illustrate the invention.

INORGANIC FINE PARTICLE SURFACE TREATMENT EXAMPLE 1

Twenty parts by weight of hexamethyl disilazane and 2 parts by weight of octadecyl dimethyl (3-(trimethoxysilyl) propyl) amonium chloride are dissolved in 500 parts by weight of ethanol. One hundred parts by weight of hydrophilic silica #380 (EH-5, made by Cabot K. K.; specific surface area, 380 $m^2/g$) were mixed with the above obtained solution. After agitation, the ethanol solvent is removed from the mixture by using an evaporator, followed by drying. Then, the silica fine particles were disintegrated by using a Henschel mixer. The resulting silica fine particles were heated to dry in an oven at 120° C. for 3 hours. The hydrophobic silica thus obtained was pulverized (disintegrated), with coarse particles classified. Thus, hydrophobic silica fine particles (A) were obtained.

INORGANIC FINE PARTICLE SURFACE TREATMENT EXAMPLES 2–7

Hydrophobic silica fine particles (B)–(G) were obtained in the same way as in Treatment Example 1, except that proportions of hexamethyl disilazane (a) and octadecyl dimethyl (3-(trimethoxysilyl) propyl) amonium chloride (b) were changed as follows:

(a)/(b)=0/2 silica fine particles (B)

(a)/(b)=10/2 silica fine particles (C)

(a)/(b)=30/2 silica fine particles (D)

(a)/(b)=20/0.5 silica fine particles (E)

(a)/(b)=20/10 silica fine particles (F)

(a)/(b)=20/0 silica fine particles (G)

INORGANIC FINE PARTICLE SURFACE TREATMENT EXAMPLE 8

Hydrophobic silica fine particle (H) was obtained in the same way as in Treatment Example 1, except that the inorganic fine particle was changed to hydrophilic silica #200 (M-5, made by Cabot K. K.; specific surface area, 200 $m^2/g$), and that surface treating agent was changed to 20 parts by weight of actylsilane and 3 parts by weight of amino-modified silicone oil (KF-857, made by Shinetsu Kagaku K. K.).

INORGANIC FINE PARTICLE SURFACE TREATMENT EXAMPLE 9

Hydrophobic silica fine particle (I) was obtained in the same way as in Treatment Example 8, except that the surface treatment agent was changed to 10 parts by weight of γ-(2-aminoethyl) aminopropylmethyl dimethoxysilane.

Measurements of silica fine particles (A)–(I) obtained as above described are summarized in Table 1 in respect of hydrophobicity, blow-off charge, presence of reverse charge component, and particle size distribution.

TABLE 1

| Silica fine particle | Hydro-phobicity | Blow -off charge | Presence of reverse charge component | Particle size distribution: Mean particle size (μm) | Particle size distribution: >30 μm (vol %) |
|---|---|---|---|---|---|
| (A) | 62 | −430 | No | 3.53 | 0 |
| (B) | 32 | −310 | Yes | 3.51 | 0 |
| (C) | 60 | −340 | No | 3.57 | 0 |
| (D) | 65 | −558 | No | 3.37 | 0 |
| (E) | 61 | −684 | No | 3.41 | 0 |
| (F) | 64 | −286 | No | 3.67 | 0 |
| (G) | 58 | −1112 | No | 3.78 | 0 |
| (H) | 58 | −513 | No | 4.18 | 0 |
| (I) | 36 | +212 | No | 4.28 | 0.4 |

In Table 1, with respect to "Presence of reverse charge component" evaluation was made in such a way that where presence of reverse charge component was recognized in a charging curve obtained during measurement of blow-off charge with respect to inorganic fine particles, that is, where the charging curve contained a reverse charge portion, evaluation was "Yes"; and where presence of reverse charge component was not recognized, evaluation was "No".

Particle size distribution of inorganic fine particles is shown in measurement values obtained by using a laser diffraction type dry particle size measuring apparatus (HELOS & RODOS, made by Nihon Laser K. K.) under conditions of: range 1:0.1–35 μm; air pressure, 6.5 bar.

Toner Particle Preparation Example 1

| | Parts by weight |
|---|---|
| Polyester resin A1 (softening point 105.1° C.) | 65 |
| Polyester resin B1 (softening point 150.1° C.) | 35 |
| Oxyidized polypropylene (Viscol 100 TS; made by Sanyo Kasei K.K.) | 3 |
| Negative charge control agent (Bontoron E-84; made by Orient Kagaku Kogyo K.K.) | 2 |
| Carbon black (Mogul L; znade by Cabot K.K.) | 8 |

Above mentioned materials were thoroughly mixed in a Henschel mixer, and then the mixture was melt and kneaded in a twin-screw extruding kneader (FCM-30, made by Ikegai Tekko K. K.). The kneaded mixture was then cooled and rolled by a cooling press roller to a thickness of 2 mm. After being cooled on a cooling belt, the rolled mixture was primarily crushed in a feather mill. Then, the primarily crushed material was pulverized by a mechanical grinder (KTM; made by Kawasaki Jukogyo K. K.) to a mean particle size of 10 to 12 μm. The pulverized material was further pulverized by a jet mill (IDS; made by Nippon Pneumatic Kogyo K. K.) to a mean particle size of 8 μm, with coarse particles classified for separation. Then, fine powder classification was made by a rotor classifier (Teeplex type classifier 1000ATP; made by Hosokawa Micron K. K.). As a result, toner particles (A) having a volume mean particle size of 8.2 μm were obtained.

Polyester resin A1 was prepared in the following way. A four-necked 2-liter flask, fitted with a reflux condenser, a water separator, a nitrogen gas introduction pipe, a thermometer, and an agitator, was placed in a mantle heater. Charged into the flask were 735 g of polyoxypropylene (2, 2)-2, 2-bis (4-hydroxyphenyl) propane and 292.5 g of polyoxyethylene (2, 0)-2, 2-bis (4-hydroxyphenyl) propane as alcoholic components, 448.2 g of terephthalic acid as dicarboxylic acid, and 22 g of trimellitic acid as tricarboxylic acid. The materials were caused to react at 220° C. under agitation while nitrogen was introduced into the flask. The progress of reaction was followed with acid value measurement. Reaction was terminated when a predetermined acid value was reached. Thus, polyester resin Al having a softening point of 105.1° C. was obtained. Softening point measurement was made by using a flow-down type flow tester (CFT-500; made by Simadzu Seisakusho K. K.) under the conditions of: die pore diameter, 1 mm; pressure, 20 kg/cm$^2$; rate of temperature rise, 6° C./min. When a 1 cm$^3$ sample was allowed to melt and effuse under aforesaid conditions, a temperature corresponding to one half of the height between the start of effusion of the sample and the end of effusion was taken as the softening point.

Polyester resin B1 was prepared in the following way. A four-necked 2-liter flask, fitted with a reflux condenser, a water separator, a nitrogen gas introduction pipe, a thermometer, and an agitator, was placed in a mantle heater. Charged into the flask were 735 g of polyoxypropylene (2, 2)-2, 2-bis (4-hydroxyphenyl) propane and 292.5 g of polyoxyethylene (2, 0)-2, 2-bis (4-hydroxyphenyl) propane as alcoholic components, 249 g of terephthalic acid and 177 g of succinic acid as dicarboxylic acid components, and 22 g of trimellitic acid as tricarboxylic acid. The materials were caused to react at 220° C. under agitation while nitrogen was introduced into the flask. The progress of reaction was followed with acid value measurement. Reaction was terminated when a predetermined acid value was reached. Thus, polyester resin B1 having a softening point of 150.1° C. was obtained.

Toner Particle Preparation Example 2

Cyan toner particles (B) were obtained in the same way as above described, except that 3 parts ("part" means "part by weight" and same hereinafter) of phthalocyanine pigment (C. I. Pigment Blue 15-3) and, 2.0 parts of zinc complex (Bontron E-84; made by Orient Kagaku Kogyo K. K.) (a salicylic acid derivative) as charge control agents, and 2.0 parts of low molecular weight polypropylene (Viscol 100TS; made by Sanyo Kagaku Kogyo K. K.) were used relative to 100 parts of a linear polyester resin having no tetrahydrofuran insoluble component (Mn, 4500; Mw/Mn, 2.3; glass transition point, 60.2° C.; softening point, 100.3° C.) obtained by use of bisphenol A propylene oxide (PO) and bisphenol A ethylene oxide (EO) as alcoholic components and fumaric acid (EA) and terephthalic acid (TPA) as acid components and.

Toner Particles Preparation Examples 3–5

Magenta, yellow, and black colored toner particles (C), (D) and (E) were obtained in the same way as in Preparation Example 2, except that in Preparation Example 3, 3 parts of C. I. Pigment Red 184 were used; in Preparation Example 4, 3 parts of C. I. Solvent Yellow 162 were used; in Preparation Example 5, 5 parts of carbon black "Mogul L" (made by Cabot K. K.) were used.

Particle size distribution of toner particles (A)–(E) thus obtained is shown in Table 2.

TABLE 2

| Toner particle | Vol mean particle size | Vol mean particle size(D) ≧ 2 D(%) *1 | Vol mean particle size(D) ≦ 1/3 D(%) *2 |
|---|---|---|---|
| A | 8.2 | 0.1 | 4.8 |
| B | 7.1 | 0.1 | 3.0 |
| C | 7.0 | 0.1 | 3.2 |
| D | 6.9 | 0.1 | 3.2 |
| E | 7.2 | 0.1 | 3.3 |

(*1: vol %; *2: number %)

Examples 1–6 and Comparative Examples 1–3

Above described toner particles (A) and surface treated silica fine particles shown in Table 3 were mixed in such proportions as shown in Table 3. Mixing was carried out in a Henschel mixer at a peripheral speed of 40 m/sec for 90 seconds. A vibrating screen was used to cause particles to pass through mesh openings of 90 μm.

TABLE 3

| Example/ Comp. Example | Toner | Silica fine particle Kind | Quantity added | Fog | Transferring properties |
|---|---|---|---|---|---|
| Example 1 | A | A | 0.8 | ○ | ○ |
| Example 2 | A | C | 0.8 | ○ | ○ |
| Example 3 | A | D | 0.8 | ○ | ○ |
| Example 4 | A | E | 0.8 | ○ | ○ |
| Example 5 | A | F | 1.0 | ○ | ○ |
| Example 6 | A | H | 1.0 | ○ | ○ |
| Comp. Example 1 | A | B | 0.8 | × | × |
| Comp. Example 2 | A | G | 0.8 | Δ | × |
| Comp. Example 3 | A | I | 1.0 | × | × |

Toners obtained were loaded in a printer (SP 101, made by Minolta K. K.) with a non-magnetic mono-component developing unit installed, and evaluation was made with respect to fogging and transferability(transferring properties). Results are shown in Table 3.

(1) Fogging

Character patterns having a B/W of 30% were printed 10 sheets successively in L/L environment (10° C., 15% RH) and H/H environment (30° C., 85% RH). Fogging was evaluated and ranked as follows;

○: Little fogging was visually found.

Δ: Slight fogging was found but no problem from the viewpoint of practical use.

x: Fogging was found all over and objectionable from the viewpoint of practical use.

(2) Transferability

With respect to transferability, three-grade evaluation was made judging from the deposit on the paper relative to the deposit on the photosensitive drum.

○: Not less than 90%

Δ: Not less than 80% x: Less than 80%

With respect to Example 1 toner, a durability test with respect to copy of 3000-sheet was carried out using a B/W ratio 5% chart in a cleaner process. No fog problem or the like was found in respect of image forming.

Toners B~E for full color with 1% by weight of silica fine particles A treated respectively were evaluated with respect to image-defects, toner-scattering and fogging at a initial stage of copy. There was no problem. In respect of transferability, the toners were also ranked as ○.

The present invention provides a toner suitable for use in a mono-component developing method such that a thin layer of charged toner, formed on a developing sleeve as toner particles are forced to pass through a pressure contact clearance between the sleeve and a toner regulating blade, acts to develop an electrostatic latent image formed on a photosensitive member. The toner has good imaging capability such that the image formed is highly transferable and is free of fogging and image defects.

What is claimed is:

1. A negatively chargeable developing agent for mono-component development comprising:

toner particles containing a binder resin and a colorant; and inorganic fine particles which are treated with a hydrophobicizing agent and a surface treating agent having a cationic group, the inorganic fine particles externally added to the toner particles and having a blow-off charge quantity (Q) of $-800<Q<0$ $\mu$C/g relative to iron oxide particles.

2. A negatively chargeable developing agent for mono-component development as defined in claim 1, wherein the surface treating agent having the cationic group is a silane coupling agent having a cationic group or a silicone oil having a cationic group.

3. A negatively chargeable developing agent for mono-component development as defined in claim 1, wherein the cationic group is an amino group or an ammonium salt group.

4. A negatively chargeable developing agent for mono-component development as defined in claim 1, wherein the hydrophobicity of the inorganic fine particles is 30% or more.

5. A negatively chargeable developing agent for mono-component development as defined in claim 4, wherein the hydrophobicity of the inorganic fine particles is 50 % or more, and the blow-off charge quantity (Q) is $-700<Q<-200$ $\mu$C/g.

6. A negatively chargeable developing agent for mono-component development as defined in claim 1, wherein the inorganic fine particles have a mean primary particle size of 0.001 to 5 $\mu$m.

7. A negatively chargeable developing agent for mono-component development as defined in claim 1, wherein the inorganic fine particles treated with the hydrophobicizing agent and with the surface treating agent having a cationic group have a volume-mean particle size of not more than 10 $\mu$m measured according to a laser diffraction dry method and contain not more than 1% by volume of particles having a particle size of 30 $\mu$m or more.

8. A negatively chargeable developing agent for mono-component development as defined in claim 1, wherein the toner particles have a volume mean particle size of 2 to 9 $\mu$m, and include not more than 2% by weight of particles having not less than two times the volume mean particle size, and not more than 5% by number of particles having a particle size of not more than one third of the volume mean particle size.

9. A mono-component developing device comprising;

a developing agent-supporting member having a movable surface and supporting a developing agent on the surface;

a developing agent layer thickness-regulating member disposed in contact with the developing agent-supporting member for forming a thin layer of the developing agent on the developing agent-supporting member;

a voltage applying member for applying a development bias voltage of a predetermined polarity to the developing agent-supporting member;

a developing agent reservoir for storing a developing agent; and a negatively chargeable mono-component developing agent including toner particles and inorganic fine particles and being accommodated in the developing agent reservoir, said toner particles containing a binder resin and a colorant, said inorganic fine particles treated with a hydrophobicizing agent and a surface treating agent having a cationic group, the inorganic fine particles externally added to the toner particles and having a blow-off charge quantity (Q) of $-800<Q<0$ $\mu$C/g relative to iron oxide particles.

10. A mono-component developing device as defined in claim 9, wherein the cationic group is an amino group or an ammonium salt group.

11. A mono-component developing device as defined in claim 9, wherein the hydrophobicity of the inorganic fine particles is 50% or more, and wherein the blow-off charge quantity (Q) $-700<Q<-200$ $\mu$C/g.

12. A mono-component developing device as defined in claim 9, wherein the voltage applying member is operative to apply a recovery bias voltage of a polarity opposite to the charging polarity of the toner particles.

13. An image-forming apparatus comprising;

an image supporting member for supporting an electrostatic latent image;

a developing device including a developing agent-supporting member for supporting a developing agent, a developing agent layer thickness-regulating member disposed in contact with the developing agent-supporting member, a voltage applying member for applying a development bias voltage of a predetermined polarity to the developing agent-supporting member, a developing agent reservoir for storing a developing agent, and a negatively chargeable mono-component developing agent including toner particles and inorganic fine particles and being accommodated in the developing agent reservoir, said toner particles containing a binder resin and a colorant, said inorganic fine particles treated with a hydrophobicizing agent and a surface treating agent having a cationic group, The inorganic fine particles externally added to the toner particles and having a blow-off charge quantity (Q) of $-800<Q<0$ $\mu$C/q relative to iron oxide particles;

a transfer device for transferring a toner image on the image supporting member to a transfer medium; and a cleaner for removing an residual developing agent left on the surface of the image supporting member after image transfer.

14. An image-forming apparatus as defined in claim 13, wherein the cationic group is an amino group or ammonium salt group.

15. An image-forming apparatus as defined in claim 13, wherein the hydrophobicity of the inorganic fine particles is 50% or more, and wherein the blow-off charge quantity (Q) is $-700<Q<-200$ $\mu$C/g.

16. An image-forming apparatus as defined in claim 13, wherein the transfer device is a roller-type transfer device.

17. A cleaner-less image-forming apparatus comprising;

an image supporting member for supporting an electrostatic latent image;

a developing device comprising a developing agent reservoir for accommodating a developing agent therein, a developing agent-supporting member for supporting the developing agent, a developing agent layer thickness-regulating member disposed in contact with the developing agent-supporting member, a voltage applying member which acts to apply a development bias voltage of a predetermined polarity to the developing agent-supporting member during the process of development and to apply a recovery bias voltage of a polarity opposite to the charging polarity of the toner particles during the process of cleaning, and a negatively chargeable mono-component developing agent including toner particles and inorganic fine particles and being accommodated in the developing agent reservoir, said toner particle containing a binder resin and a colorant, said inorganic fine particles treated with a hydrophobicizing agent and a surface treating agent having a cationic group, the inorganic fine particles externally added to the toner particles and having a blow-off charge quantity (Q) of $-800<Q<0$ $\mu$C/g relative to iron oxide particles; and a transfer device for transferring a toner image on the image supporting member to a transfer medium.

18. A cleaner-less image-forming apparatus as defined in claim 17, further comprising a contact charging device.

19. A cleaner-less image-forming apparatus as defined in claim 17, wherein the cationic group is an amino group or an ammonium salt group.

20. A cleaner-less image-forming apparatus as defined in claim 17, wherein the hydrophobicity of the inorganic fine particles is 50% or more, and the blow-off charge quantity (Q) is $-700<Q<-200$ $\mu$C/g.

* * * * *